United States Patent [19]

Berge

[11] 4,003,332

[45] Jan. 18, 1977

[54] INFORMATION DISPLAY DEVICE

[76] Inventor: Arthur Berge, Kilian Zollsgatan 5, 217 56 Malmo, Sweden

[22] Filed: June 25, 1975

[21] Appl. No.: 590,131

[30] Foreign Application Priority Data

Dec. 16, 1974 Sweden ..... 7415297

[52] U.S. Cl. ..... 116/131; 40/77.6

[51] Int. Cl.[2] ..... G09F 11/02

[58] Field of Search ..... 116/130–135; 40/68, 77.4, 77.6, 77.8; 35/77

[56] References Cited

UNITED STATES PATENTS

| | | | |
|---|---|---|---|
| 1,087,235 | 2/1914 | Hooper | 40/68 |
| 2,302,296 | 11/1942 | Cluett | 116/135 X |
| 2,412,238 | 12/1946 | Wassel | 116/135 |
| 2,629,951 | 3/1953 | Kittridge | 35/77 |
| 3,201,882 | 8/1965 | Alford et al. | 116/135 X |
| 3,680,525 | 8/1972 | Berge | 116/135 X |
| 3,717,942 | 2/1973 | Presby | 40/77.4 X |

FOREIGN PATENTS OR APPLICATIONS

| | | | |
|---|---|---|---|
| 499,685 | 6/1930 | Germany | 116/135 |

*Primary Examiner*—Richard C. Queisser
*Assistant Examiner*—Daniel M. Yasich
*Attorney, Agent, or Firm*—Young & Thompson

[57] ABSTRACT

Apparatus for information display comprising a plurality of parallel, rotatable rolls having axially movable indicia on the surface thereof and indicator rods positioned adjacent and perpendicular to the rolls and parallel to the common plane of the axes of the rolls.

3 Claims, 6 Drawing Figures

INFORMATION DISPLAY DEVICE

The present invention relates to a device for information handling, planning, control and the like by means of relatively movable indicators.

By devices of the type shown and described in Swedish patents. Nos. 193,760 and 197,969 and U.S. Pat. No. 3,680,525 planning problems of various kinds have been solved and further can be solved by devices according to these patents. It has, however been found that there are planning problems where the above-mentioned devices do not satisfy all practical demands. The present invention makes, however, the necessary improvements.

Among earlier known devices the so called Gantt-type can be mentioned, for example as described in U.S. Pat. No. 2,412,238 and German Pat. No. 844,685.

Such devices are in the form of boards with a time scale and denominations in the same plane. Another device of the Gantt-type embodies a rotatable cylinder where e.g. the x-axis, intended for denominations, is placed on the cylinder, and the y-axis consists of a time scale which is placed outside the cylinder in parallel to the axis of rotation. A typical invention of this type is shown in Belgian Pat. No. 723,251.

The diagram or the schedule, obtained by the device according to Belgian Pat. No. 723,251 or the like, is what can be obtained if a diagram of the type which can be produced in accordance with the device shown in German Pat. No. 844,685, is folded around the cylinder according to Belgian Pat. No. 723,251. It is, however, possible to see only a part of the diagram at a time, and to see it completely it is necessary to rotate the cylinder, Planning in a real sense can not be performed by devices of the Gantt-type. By devices according to Swedish Pat. Nos. 193,760 and 197,969 and U.S. Pat. No. 3,680,525 as mentioned in the introduction, a number of planning problems have been solved. A simplified form of planning program, according to the last-mentioned patents, is shown in FIG. 1.

The insufficiency of devices of the Gantt-type is obvious if a diagram as in FIG. 1, which relates to an earlier known device, is folded around the cylinder according to Belgian Pat. No. 723,251. It will show that of the variables of the four dimensions: subjects, classrooms, teaches and classes, only a few variables, belonging to one of the variables, are visible, which is insufficient because when planning, at least some of the variables in each of the four mentioned dimensions must be observed simultaneously. By the present invention these lacks can be overcome simply by placing a planning program of the type of FIG. 1, according to the invention, on two or more rotatable rolls and locating a scale in parallel to the rotation axis of the rolls outside the rolls.

To be able to implement, according to the invention, for example a program in accordance with FIG. 1, a device with four rolls and one scale is required. Such devices need only a fraction of the height which a planar board requires for the same quantity of information.

A certain type of program, which earlier had to be placed on two or several devices as in FIG. 1, can be placed on only one device according to the present invention, without having too great a size.

A planning system of the type shown in FIG. 1, comprising further more variables than shown in FIG. 1, can be embodied in a board-like apparatus of a height of 186 cm and a width of 120 cm. An apparatus of this size contains 300 rails on which movable indicators can be placed. The most usual school time-tables can be handled with such an apparatus, or if the program is large (e.g. if the school has more than 50 teachers), it can be placed on two or several board-like apparatus. However, in some cases a certain program is difficult to divide and requires a space which can be expressed for example, with 400 rails, which gives the apparatus a height of 250 cm. Such a large device could not pass through most door openings.

A device according to the present invention, comprising 400 rails would have a height of only 80 cm, which has several practical advantages.

An apparatus in accordance with the invention will in addition to the capacity to contain much information on a small space, also have the capacity to be easily transported. This is obviously of great importance in many industrial applications, for example in building enterprises where the planning program is done in the head office whereas the information is utilized elsewhere.

The present invention is characterized in that the program is distributed over a number of individually rotatable rolls, for example so that on one roll is placed subjects, on another roll classrooms, on a third roll teachers and on a fourth roll the classes. The rolls are attached to a console supplied with a scale, e.g. a time scale, so that the rolls are rotatable relative to the time scale, whereby the variables belonging to the different dimension of the program give visual interrelations between the variables.

As shown in FIG. 2, there will always be more than one variable indicator visible in every dimension which gives the device a vast range of application.

Improvements include the possibility that the rolls consist of magnetic material and the indicators of magnets. The arrangement which in general is to be preferred, is that in which the indicators support consists of rails with keyhole cross-section, as shown in FIGS. 3 and 4.

When using the invention for periodical programs, for example time-tables where changes of calendar and corresponding updating do not occur, the invention has advantages compared with prior art devices.

The invention can also be used for non-periodic programs of continuous types, for example the above-mentioned planning program for building activities.

It is important that the device according to the invention, can be placed on, or in association with a desk whereby programming, planning work, control, etc. will be simplified considerably.

The invention will further be described with reference to the accompanying drawings, in which.

Figure 4:
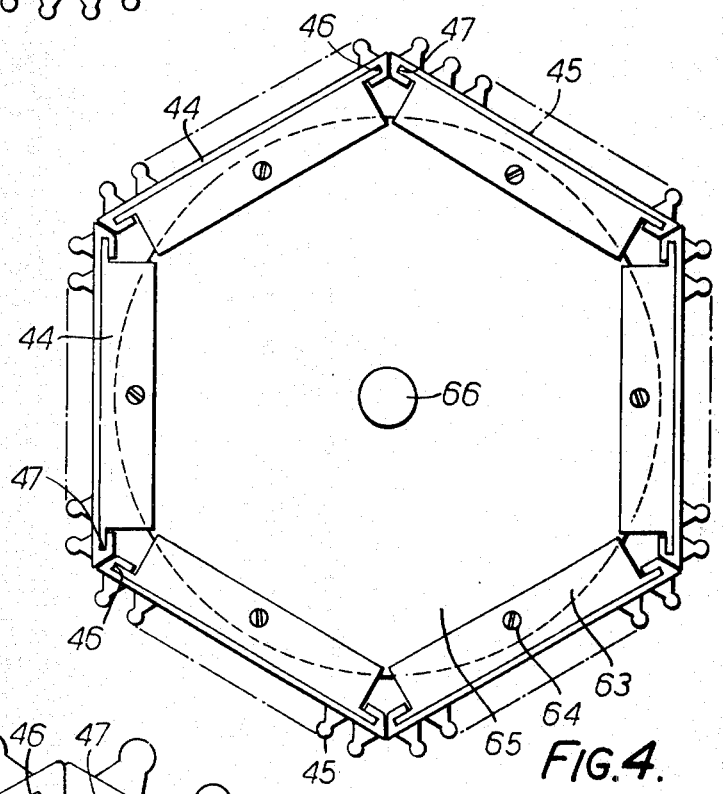
FIG. 4 is an end view of a roll having a polygonal cross-section.
Figure 4A:
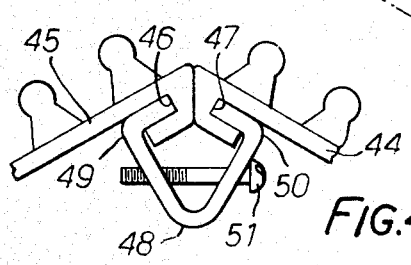
Figure 5:
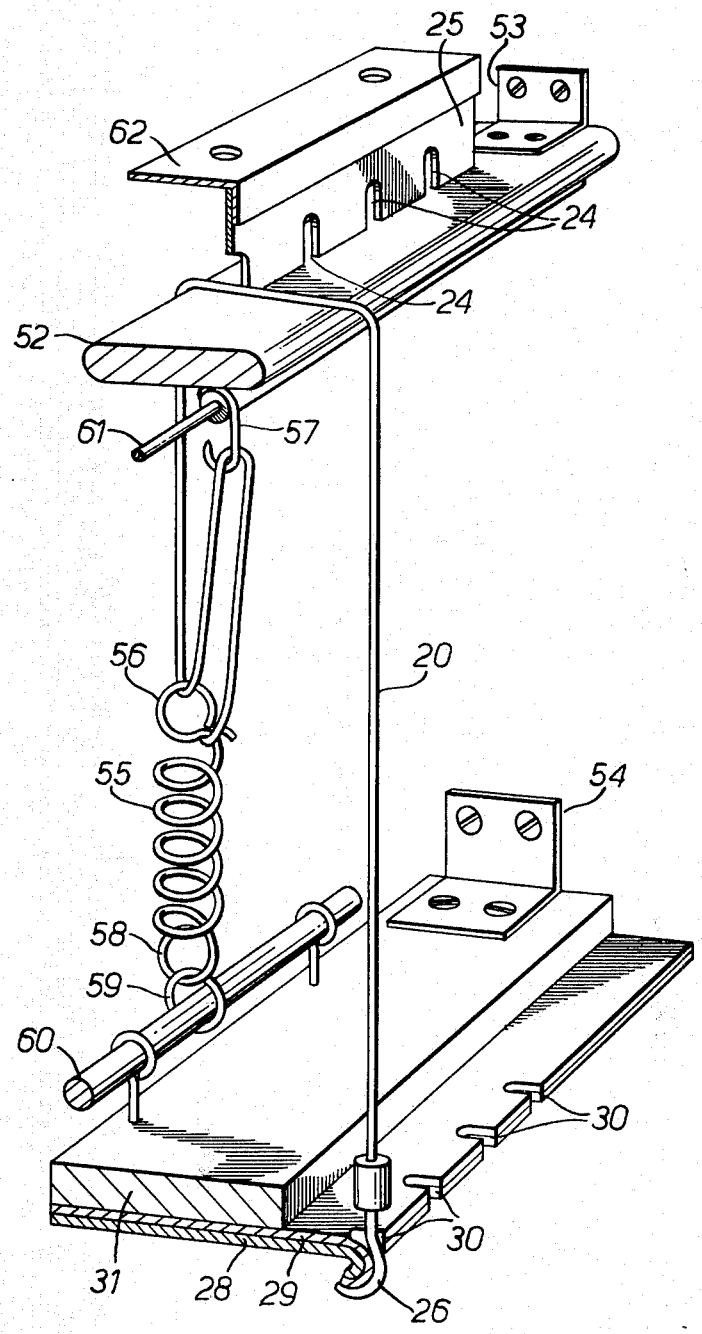

FIG. 4*a* is an enlarged fragmentary view of an arrangement for joining the indicator rail's plates; and FIG. 5 is a perspective view of an arrangement of indicator rods.

Figure 1:
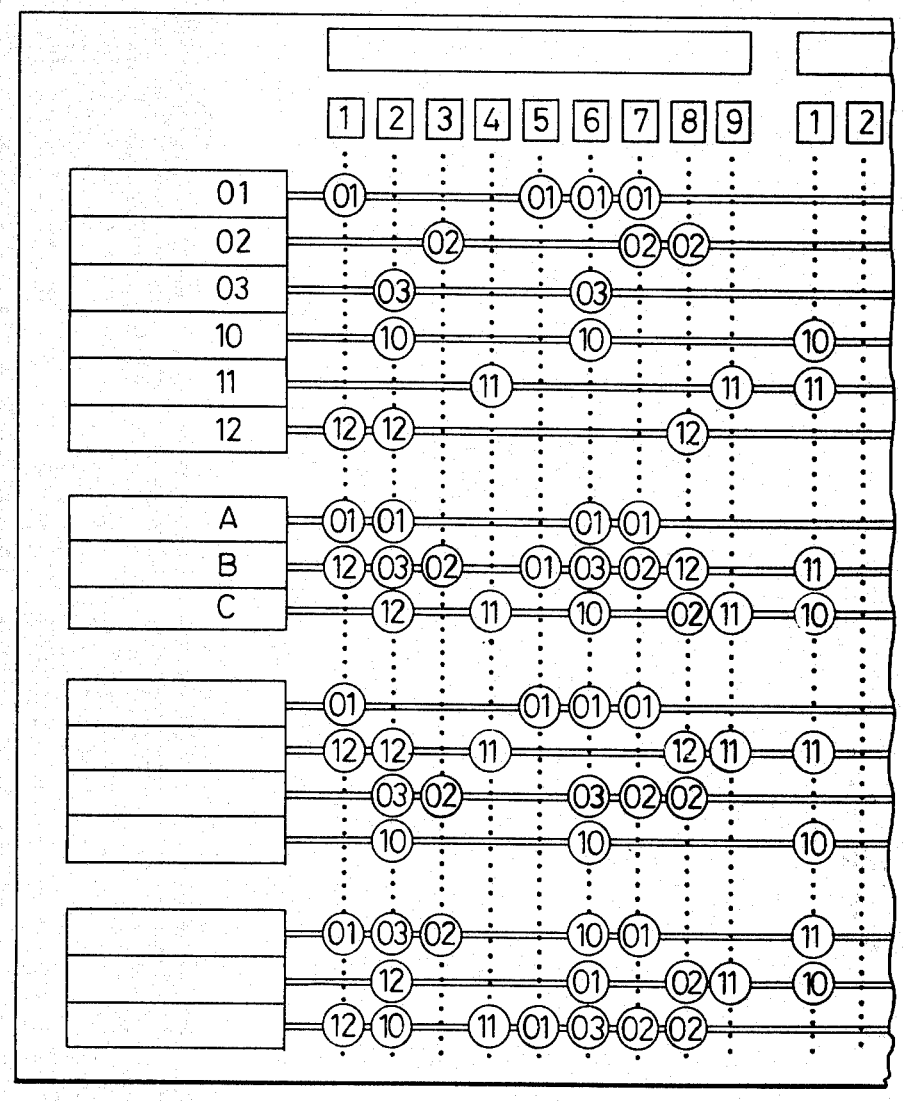
FIG. 1 is an elevational view of a planning board of a known type.

Referring now to the drawings in greater detail, FIG. 1 is a fragment of a program board which is a simplified form of what is disclosed in U.S. Pat. No. 3,680,525. The figure is intended to show the type of device which the invention relates to. To the indicators support a time scale is attached, which in this case is divided into days and hours. The denominations support, which is situated at the left in FIG. 1, is arranged to represent activities and resources. In the present case the activities are certain school subjects and have been given numbers 1, 2, 3 . . . 10, 11, 12. The classrooms A, B, C and the teachers represent the resources. Concerning the device, the method and its use, refer to U.S. Pat. No. 3,680,525.

As mentioned in the introduction, a program according to FIG. 1 can be arranged on relatively movable indicators support means. According to the example four indicators supports are required if every dimension which relates to activities and resources (subjects, classrooms, teachers and classes) in the program, is placed on separate indicators support. With rolls having circular or polygonal cross-section the program can be placed around the respective rolls whereby a great deal of information can be placed in a small space with the advantages mentioned in the introduction.

Figure 2:
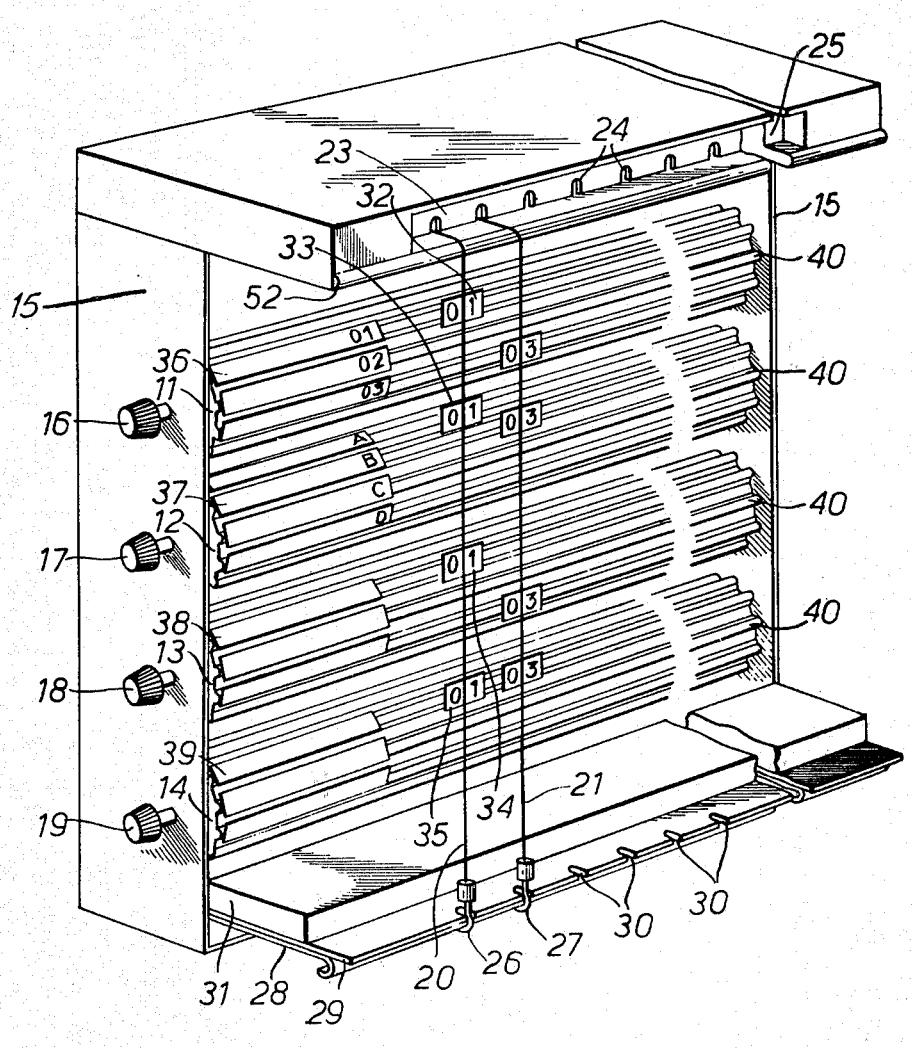
FIG. 2 is a perspective view of a device according to the invention where the indicators support consists of four cylinders.
Figure 3:
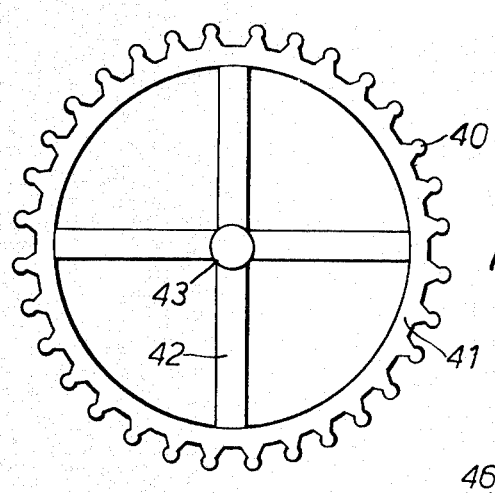
FIG. 3 is an end view of a roll in the form of a cylinder, provided with rails.

FIG. 2 represents an embodiment of the invention where the indicators support consists of cylinders 11, 12, 13, 14 with the cross-section shown in FIG. 3. The cylinders are rotatably mounted in the frame of a console 15. Thus each end of the axle can have knobs 16, 17, 18, 19 by which the rolls 11, 12, 13, 14 can be turned or rotated.

The console has devices for the indicator rods, comprising a plurality of elongated indexing members, and two of them are shown at 20 and 21. The indicator rods, which are attached to springs situated inside the console, are spaced in accordance with the graduations of a scale 23, by recesses 24 equally distributed along a member 25 which is attached to the top of the console. The ends of the indicator rods are attached to hooks 26, 27 which can be fastened to a device mounted at the bottom of the console. This device constituted by an L-shaped member 28 in which the hooks 26, 27 can be fastened and element 29 which has recesses 30 with the same spacing as the recesses 24 in the upper part. The recesses 30 are intended to prevent the hooks from sliding laterally. Thus the indicator rods 20, 21 are parallel and equally spaced. The plate 31 constitutes a reinforcement and members 28 and 29 can be provided as separate elements, or joined together. The members 28 and 29 are attached to the lower part of the frame.

The indicators 32, 33, 34 and 35 are so located on the indicators support as to constitute a program which visually refers to the denominations 36, 37, 38 and 39 and the scale 23. The denominations can be marked directly on the indicators support or on labels placed in holders of the type shown in the above-mentioned U.S. Patent. The indicators support 11, 12, 13 and 14 may instead of being made as shown in FIG. 3, also consist of a magnetic material, with card-pockets, peg-holders and pegs or various forms of tracks or rails. Such embodiments are well known.

FIG. 3 shows an embodiment where an indicators support has the form of a cylinder that may be used in lieu of the form of cylinder shown in FIG. 2. This cylinder has rails 40 of keyhole form, to support the indicators. The mantle of the cylinder 41 may be formed from metal or plastic in one piece by extrusion. On the inside of the cylinder the spokes 42 are attached to the hub 43.

The diameter of an indicators support, in accordance with FIG. 3, is limited. If larger indicators supports are required than can be produced by extrusion in one piece, they can be produced in another way, for example as shown in FIG. 4.

FIGS. 4 and 4*a* show an indicators support which may be used in lieu of that of FIG. 2 and which consists of plates with rails 44, 45 provided with a tongue and groove design, but on the inside of each plate, openings 46, 47 have been arranged, which provide support for the jaws 49, 50 of the clips 48. A number of such clips are spaced along the plates in the longitudinal direction. The pressure is regulated by the screw 51. The indicators supports made of such rolls have the advantage in that all rolls may be turned so the rolls have one side in the same vertical plane, thus it is possible to consider for example twenty rails of each roll simultaneously and the corresponding indicators of each roll of the device.

FIG. 4 shows how a roll may be composed of a number of planar plates. To each plate are attached L-shaped angles 63, and in each leg of the angles 63 there is a hole for screws 64 to be fastened in the round plate 65. There is a hole 66 in the plate 65 for the axle of the roll, whose ends may be provided with knobs 16, 17, 18, 19 as shown in FIG. 2.

The device is provided with four rolls but can be built for five, six or several rolls depending on the kind of problem to be handled.

FIG. 5 shows an enlarged perspective view of a device for tensioning the indicator rods. According to FIG. 5 one end of indicator rod 20 is attached to a hook 26. The indicator rod 20 passes over an element 52 through a recess 24, through the eye 56 of a spring 55, over a hook 57 and back to the spring 55 where the end of the rod is attached under the eye 56. The other eye 58 of the spring 55 is attached to a clip 59 which is attached to a bolt 60 which is attached to the bottom of the device.

The element 52 and the plate 31 are attached to the frame of the console for example with brackets 53, 54. The hook 57 may be attached to a bolt 61 which is parallel to the element 52 and is attached to the latter. The part 25 is attached to the part 62 which in its turn is fastened with screws at the top of the console. As the parts 25 and 62 are easily removable and the spring 55 can easily be freed and the rod 20 freed from the hook 57, the rod 20 and the spring 55 can easily be changed. This is important in the case where the device is intended for a certain type of program wherein, for example, the scale is divided into the hours of a day for one week and the rods have different colors for each of, say, nine hours of the day and wherein it is necessary to change the device and use it for another program which requires a scale divided into, say, the seven days of a week.

Other advantages of the device in accordance with FIG. 5 are that it is possible to use shorter springs than in prior art devices and also that the pressure on the element 52 will be reduced.

The present invention could be used for various types of planning program. The invention has, however, as easily understood, a vast range of applications.

What is claimed is:

1. A device for displaying a program and its progress, the program being constituted by respective program factors of at least three groups of different types, of which at least two are distributed on at least two rolls, one of said groups of program factors being common to all the other program factors, said device comprising a plurality of indicator support rolls with axes spaced apart and parallel to each other and lying in the same plane, means for mounting said rolls for selective rotation with respect to one another about their axes, scale means outside the rolls and disposed parallel to the common plane of the axes of the rolls, each of said rolls having a plurality of tracks structurally integral with the rolls and extending parallel to the axes of the rolls, indicator means slidably mounted on the tracks, each of the indicator means having thereon a visible indicium the visible indicium indicating the different types of program factors and indicating the interrelationship between the different types of program factors on each of said rolls, one group of sequentially arranged indicia indicating the program factor common to the other program factors, said sequentially arranged indicia being associated with said scale means and the visible indicium indicating the different types of other program factors being in alignment with respective ones of the sequentially arranged indicia on one of the indicator support rolls, said scale means comprising a plurality of spaced parallel elongated indexing members that lie in a common plane parallel to but spaced from the plane of said axes, said indexing members being perpendicular to said axes.

2. A device as claimed in claim 1, said rolls being disposed side-by-side and being lengthwise coextensive with each other.

3. A device for displaying information, comprising a plurality of spaced parallel indicator support rolls whose axes lie in a common plane, the length of each roll overlying the length of and being longitudinally coextensive with the adjacent said roll whereby said rolls are disposed in side-by-side relationship with each other, said rolls being mounted on support means for selective rotation about their axes relative to one another, means for selectively individually rotating each said roll about its axis, each said roll having a plurality of tracks thereon extending lengthwise of the roll parallel to the axis of the roll, said tracks on each said roll being spaced apart peripherally about the roll, indicator means slidably mounted on the tracks for adjustive sliding movement lengthwise of the roll, each said indicator means having thereon a visible indicium, and a plurality of elongated indexing members mounted in parallel spaced apart relationship on said device in a common plane which is parallel to but spaced from the common plane on the axes of said rolls, said elongated indexing members being perpendicular to the axes of said rolls and overlying said rolls.

* * * * *